US010220980B2

(12) United States Patent
Randazzo

(10) Patent No.: US 10,220,980 B2
(45) Date of Patent: Mar. 5, 2019

(54) HANDS FREE POPCORN BUCKET AND METHOD FOR PRODUCING SAME

(71) Applicant: Christopher W. Randazzo, Fishers, IN (US)

(72) Inventor: Christopher W. Randazzo, Fishers, IN (US)

( * ) Notice: Subject to any disclaimer, the term of this patent is extended or adjusted under 35 U.S.C. 154(b) by 304 days.

(21) Appl. No.: 15/095,261

(22) Filed: Apr. 11, 2016

(65) Prior Publication Data

US 2017/0291739 A1 Oct. 12, 2017

(51) Int. Cl.

| | |
|---|---|
| ***B65D 25/24*** | (2006.01) |
| ***B65D 1/16*** | (2006.01) |
| ***A47G 19/02*** | (2006.01) |
| ***B65D 3/06*** | (2006.01) |

(52) U.S. Cl.

CPC ..... *B65D 25/24* (2013.01); *A47G 19/02* (2013.01); *B65D 1/16* (2013.01); *B65D 3/06* (2013.01)

(58) Field of Classification Search

CPC ..... A47C 7/68; A47G 19/02; A47G 19/06; B31C 7/02; B31D 5/0004; B65D 1/16; B65D 25/24; B65D 3/08

USPC ..... 206/542; 220/628; 229/4.5, 400

See application file for complete search history.

(56) References Cited

U.S. PATENT DOCUMENTS

| | | | | |
|---|---|---|---|---|
| D57,719 | S | 4/1921 | Pfeiffer | |
| 5,082,140 | A | 1/1992 | Swenson | |
| 5,180,079 | A | 1/1993 | Jeng | |
| D356,010 | S | 3/1995 | McEntee | |
| D360,112 | S | 7/1995 | McEntee | |
| D397,915 | S | 9/1998 | McNaughton | |
| 6,382,449 | B1 | 5/2002 | Kazmierski et al. | |
| D488,741 | S | 4/2004 | Moya | |
| D517,178 | S | 3/2006 | Bickford | |
| D521,129 | S | 5/2006 | Bickford | |
| D569,175 | S | 5/2008 | Mansfield et al. | |
| 7,748,536 | B2 | 7/2010 | Cassese et al. | |
| D631,699 | S | 2/2011 | Moreau | |
| 8,272,529 | B2 | 9/2012 | Mansfield et al. | |
| 8,967,381 | B2 * | 3/2015 | Cassese ..... | A47G 19/06 206/542 |
| D737,098 | S | 8/2015 | Smith | |
| D739,615 | S | 9/2015 | Robertson | |
| 2006/0021986 | A1 | 2/2006 | Mansfield et al. | |

* cited by examiner

*Primary Examiner* — James N Smalley
*Assistant Examiner* — Madison L Poos
(74) *Attorney, Agent, or Firm* — Woodard, Emhardt, Henry, Reeves & Wagner, LLP

(57) ABSTRACT

A hands free popcorn bucket for removably mounting in a recess of a cup holder. An upper container is joined to a hollow base that is extended into the cup holder recess. A rim is formed at the bottom of the upper container preventing the bucket from rocking back and forth when resting atop an arm of a chair.

9 Claims, 6 Drawing Sheets

HANDS FREE POPCORN BUCKET AND METHOD FOR PRODUCING SAME

BACKGROUND OF THE INVENTION

Field of the Invention

This invention is in the field of containers and more specifically containers for holding edible products, such as, popcorn.

Description of the Prior Art

In my U.S. Design Patent D746,110 issued Dec. 29, 2015, I disclose a popcorn bucket that has a bottom portion to extend into a cup holder recess of a chair arm, for example, as typically found in a movie theatre or other such entertainment facility. My disclosure herein provides for the utility aspects of my invention.

A variety of different types of containers have been provided for holding edible products and in particular products that are consumed while watching various entertainments and in particular movies. In many cases, the containers are quite large with the food provided within the container being shared by two people sitting side-by-side in separate arm chairs. As a result, containers have been provided with a bottom extension which will fit into the cup holder recess provided in the chair arm thereby eliminating the need for separately holding the container. Several different versions are disclosed in the U.S. Pat. No. 7,748,536 issued to Cassese et al.

A sample of prior art containers include those disclosed in U.S. Pat. No. 5,180,079 issued to Jeng, U.S. Pat. No. 6,382,449 issued to Kazmierski et al. and U.S. Pat. No. 1,665,289 issued to Weaver. In both the Jeng and Kazmierski et al. patents, multiple containers are disclosed in a stacked condition. Despite the prior art containers, there is still a need for a container that may be removably held in the cup holder recess of a chair with the container being relatively stable preventing the container from being knocked out of the cup holder and spilled onto people located adjacent the cup holder. At the same time, the container must be easily inserted into and then removed from the cup holder. Disclosed herein is a hands free popcorn bucket that improves over the prior devices and in particularly provides rigidity and stability relative to the bucket and the arm chair.

In addition to disclosure of the structure of my new and improved bucket, I have further disclosed a method for producing same employing low cost techniques and materials. The method includes producing the bucket manually or manufactured in automated fashion.

SUMMARY OF THE INVENTION

One embodiment of the present invention is a hand free popcorn bucket for removably mounting into a recess of a cup holder formed in an arm of a chair. An upper container has a container side wall and a container bottom wall joined together with an open top forming a cavity for receiving popcorn. The container bottom wall has edge portions joined to the container side wall and further has a center portion with downwardly extending portions defining an opening allowing the popcorn in the container to fall downwardly from the container. A lower cup shaped base has a base side wall with inwardly facing surfaces and a base bottom wall joined to the base side wall. The base side wall is sized to fit into the recess of a cup holder formed in an arm of a chair supporting the upper container there above. The downwardly extending portions of the upper container bottom wall extend into the base resting against the inwardly facing surfaces of the base side wall and joined thereto securing the upper container to the lower cup shaped base and allowing the popcorn in the container to fall downwardly therefrom into the base. The upper container side wall extends downwardly from the container bottom wall forming a rim extending beneath the container bottom wall surrounding the base side wall and forming an annular recess located inwardly of the container side wall. The downwardly extending portions of the container bottom wall forming the rim provide rigidity for the container while supporting the container atop the arm of the chair.

Another embodiment of the present invention is a method of forming a popcorn bucket for removably mounting into a recess of a cup holder formed in an arm of a chair with the bucket having an upper container and a lower container comprising the steps of producing an upper container by rolling a flat piece of wax coated paperboard so that the upper container has opposite end portions, a top edge portion and a bottom edge portion and form an inverted frustoconical shape The opposite end portions are joined together with the frustoconical shape having an open top, an open bottom and a continuous container side wall. The top edge portion is curled forming a top rim. The bottom edge portion is folded inwardly and then upwardly forming a continuous container channel located inwardly of the bottom edge portion. A disk shaped piece of wax coated paperboard with outer edge portions forms a container bottom wall. The disk shaped piece is extended across the open bottom to form the bottom wall of the upper container. The outer edge portions of the disk shaped piece are extended downwardly into the channel. A central opening is formed in the container bottom wall creating the downwardly extending pieces of the bottom wall. The container side wall is extended downwardly past the container bottom wall forming a container rim extending beneath the container bottom wall while surrounding the base side wall forming an annular container recess located between the container side wall and the downwardly extending portions of the container bottom wall thereby providing rigidity for the container while supporting the container atop the arm of a chair.

It is an object of the present invention to provide a hands free popcorn bucket having exceptional rigidity and stability when mounted to an arm chair cup holder.

A further object of the present invention is to provide a method for producing a hands free popcorn bucket in a relatively inexpensive manner.

In addition, it is an object of the present invention to provide a new and improved container for holding edible products to be shared between adjacent consumers.

Related objects and advantageous of the present invention will be apparent from the following description.

DESCRIPTION OF THE PREFERRED EMBODIMENTS

Figure 1:
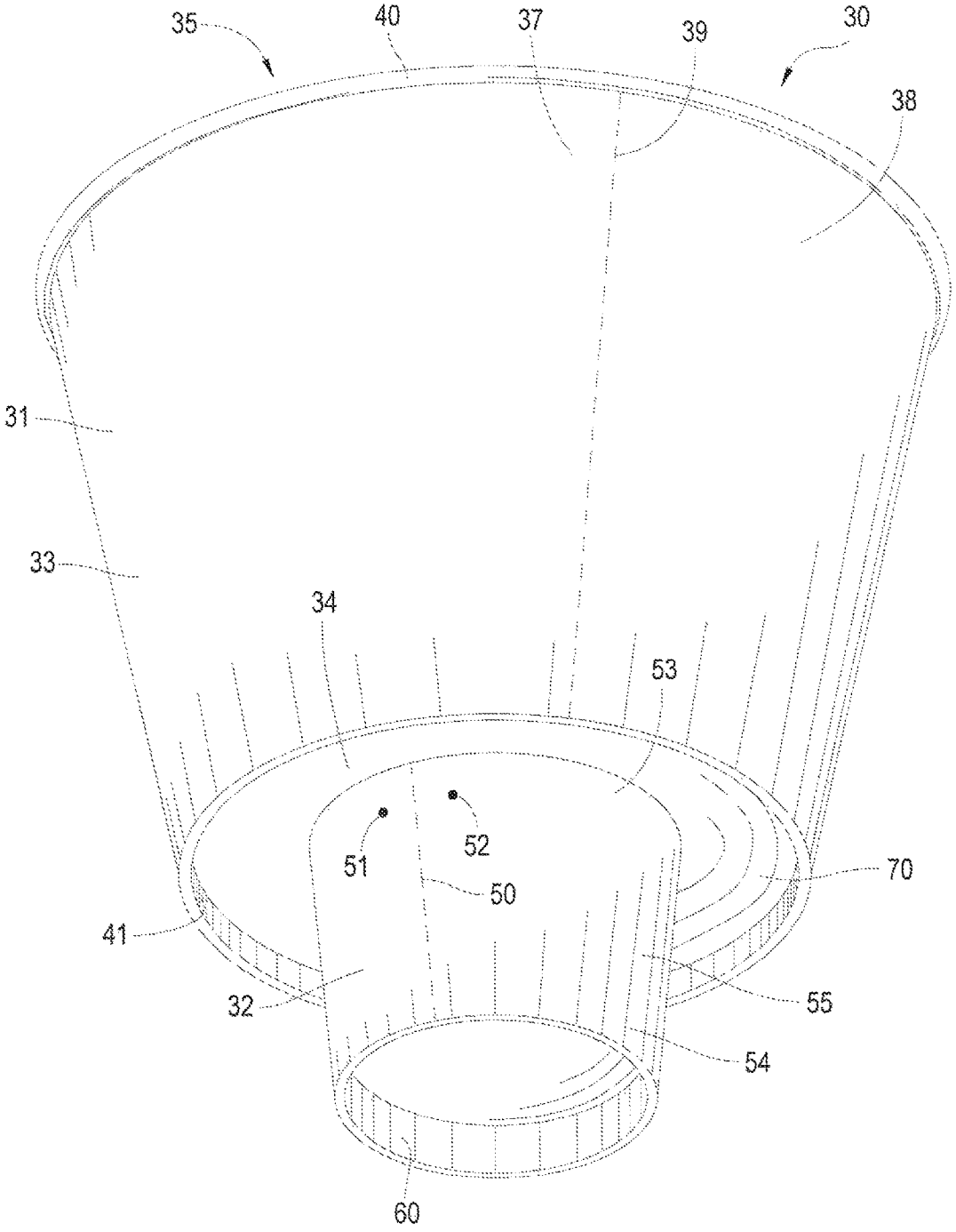
FIG. 1 is a bottom perspective view of the preferred embodiment of the bucket incorporating my new invention.
Figure 2:
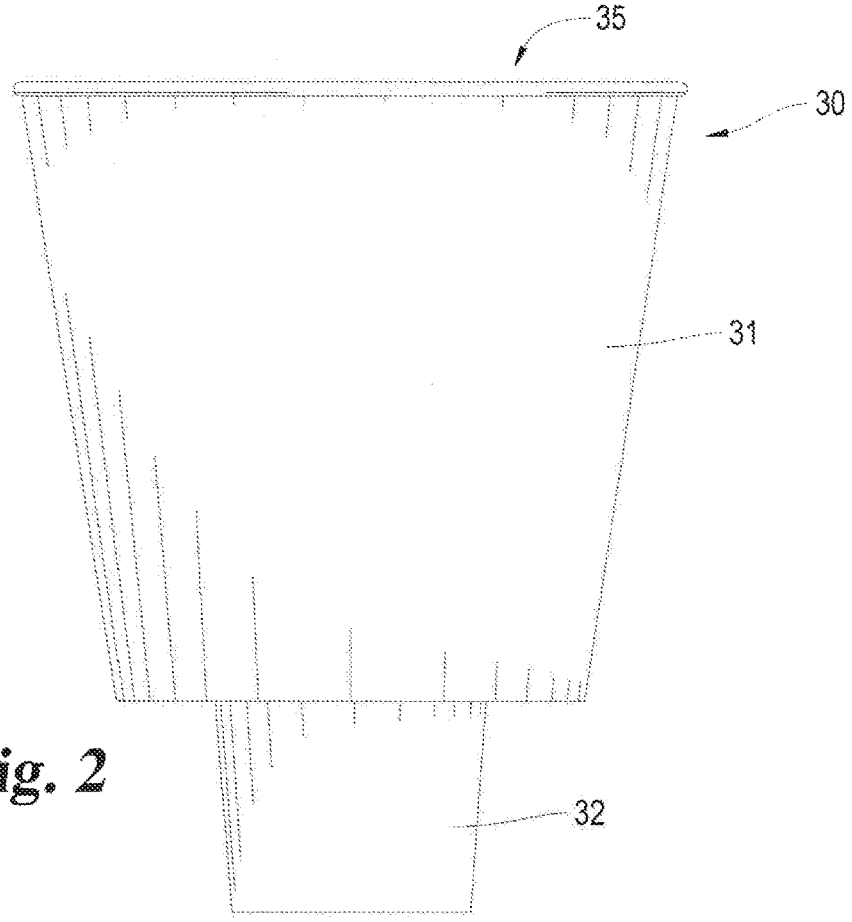
FIG. 2 is a front view with the left side, right side, and rear side being identical thereto.
Figure 3:
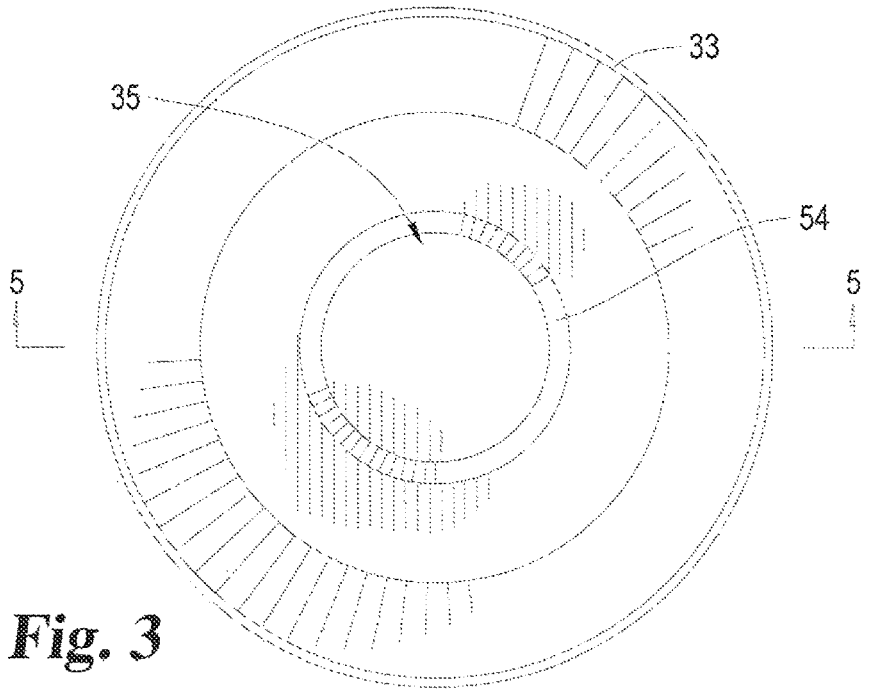
FIG. 3 is a top view thereof.
Figure 4:
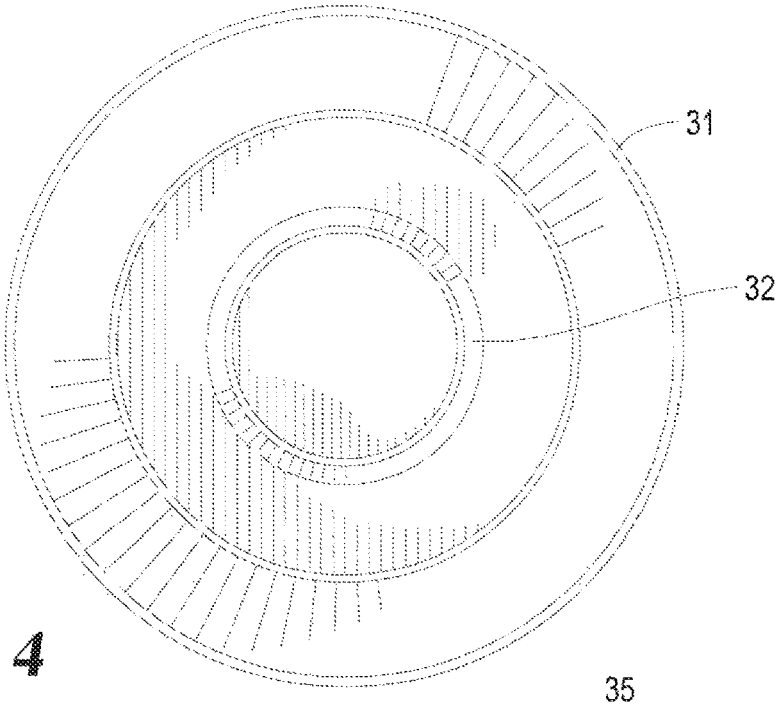
FIG. 4 is a bottom view thereof.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIGS. 1-5, the preferred embodiment of the hands free popcorn bucket is shown. Bucket 30 includes an upper container 31 and a lower cup shaped base or lower container 32 joined together. The cup shaped base 32 is configured to removably mount into the recess of a cup holder formed in the arm of a chair. Upper container 31 has a continuous, ring-shape, container side wall 33 and a container bottom wall 34 joined together to form a top 35 opening into a cavity 36 (FIG. 5) for receiving popcorn or other edible products. Side wall 31 (FIG. 1) is produced by rolling a flat piece of wax coated paperboard having opposite end portions 37 and 38 (FIG. 1) joined along a seam 39 into a continuous side wall. In the embodiment depicted in FIG. 5, side wall 31 forms an inverted frustoconical shape having a cylindrical top edge 40 and a cylindrical rim 41. The inside diameter of top edge 40 has a diameter greater than the inside diameter of rim 41 which extends continuously around the lower cup shaped base 32.

The top edge portion 40 (FIG. 5) is curled outwardly and downwardly providing a rigid top for container 31. The rim 41 is formed by folding the bottom edge portion inwardly and then upwardly forming a continuous container channel 43 into which the outer edge portions 44 of the bottom wall 34 are inserted and secured. The bottom wall 34 is produced by forming a disk shaped piece of wax coated paperboard having an outer edge portion 44 surrounding the bottom wall. Edge portions 44 are folded downwardly and then inserted into channel 43 and secured in the channel by any number of conventional means, such as by adhesive.

The center portion 46 (FIG. 5) of bottom wall 34 forms an opening 47 allowing the popcorn or other edible products within container 31 to fall into the hollow interior of the lower cup shaped base 32. Opening 46 is positioned within the bucket to be aligned with the center longitudinal axis 45 extending therethrough. Opening 47 is formed by creating a hole in bottom wall 34 with the downwardly extending portions 48 of bottom wall 34 extended into the lower cup shaped base 32 and fixedly secured to the interior surface 49 of the side wall of base 32 by conventional fastening means, such as by adhesive.

The lower cup shaped base 32 is formed in a manner similar to the formation of container 31 in that the base 32 is produced by rolling a flat piece of wax coated paperboard having opposite end portions 51 and 52 (FIG. 1) in a cylindrical or ring shape with the end portions 51 and 52 then being joined permanently along seam 50 by suitable fastening means. As is the case of container 31, base 32 has an inverted frustoconical shape, that is, the inside diameter of the base decreases from the top portion 53 of the base to the bottom portion 54 of the base. In other words, the inside diameter of the base side wall 55 has a diameter greater at the top end 53 than at the bottom end 54.

The base side wall 49 has a cylindrical bottom edge 60 (FIG. 5) that extends downwardly and then inwardly forming a cylindrical channel 61. The bottom wall 62 of base 32 is disk shaped and extends between the opposite side walls 55. Bottom wall 62 has a continuous outer edge portion 63 that extends downwardly into channel 61 with edge portion 63 then being permanently joined within channel 61 to the base side wall 32. As is the case with the upper container, base 32 has an inside diameter that is smaller at the bottom of the base as compared to the inside diameter located at the top of the base.

An alternate embodiment of the hands free popcorn bucket 130 is shown in FIGS. 6-10. Bucket 130 is identical bucket 30 of FIG. 1 with the exception that the bottom wall 134 (FIG. 10) has an outer edge portion 136 that is turned upwardly instead of downwardly as the case of the container of FIG. 5 and is permanently affixed to the inside surface 137 of the side wall 133 of container 131. As a result, bottom wall 134 is aligned with the bottom edge 140 of the cylindrical side wall 133 and a recess is not created at the bottom of upper container 131 as is the case with recess 70 (FIG. 1) for the upper container. Side wall 133 has an inside diameter smaller than the inside diameter of the side wall 33 of the upper container.

Figure 5:
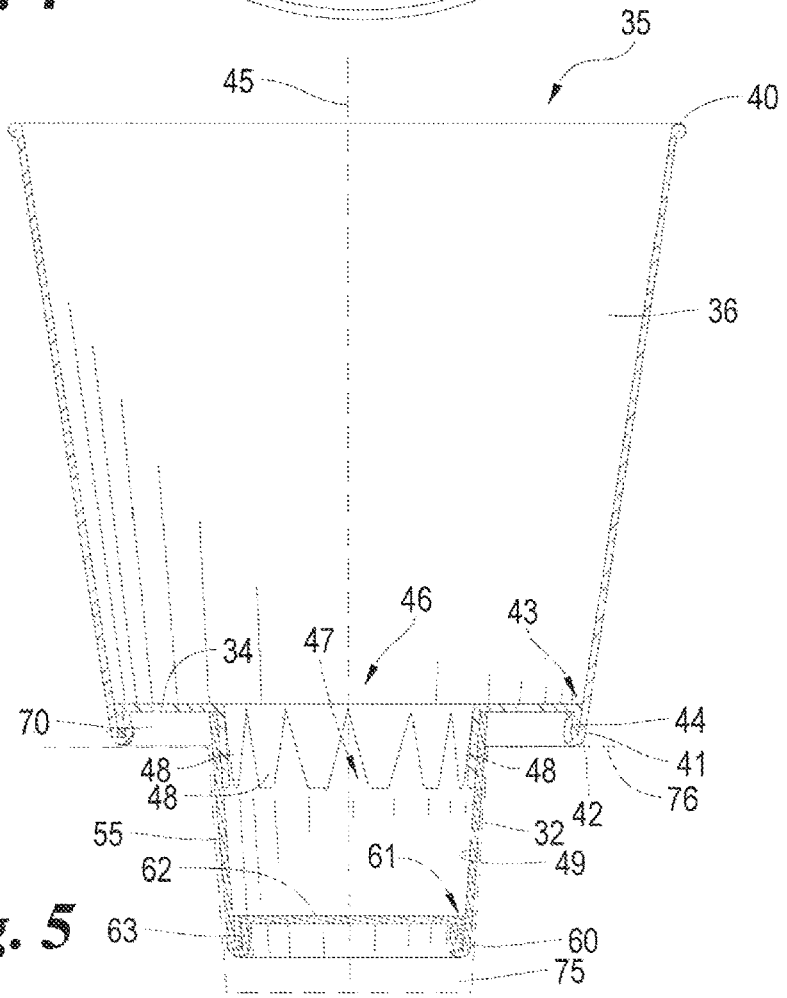
FIG. 5 is a cross sectional view thereof; taken from line 5-5 in FIG. 3.
Figure 6:
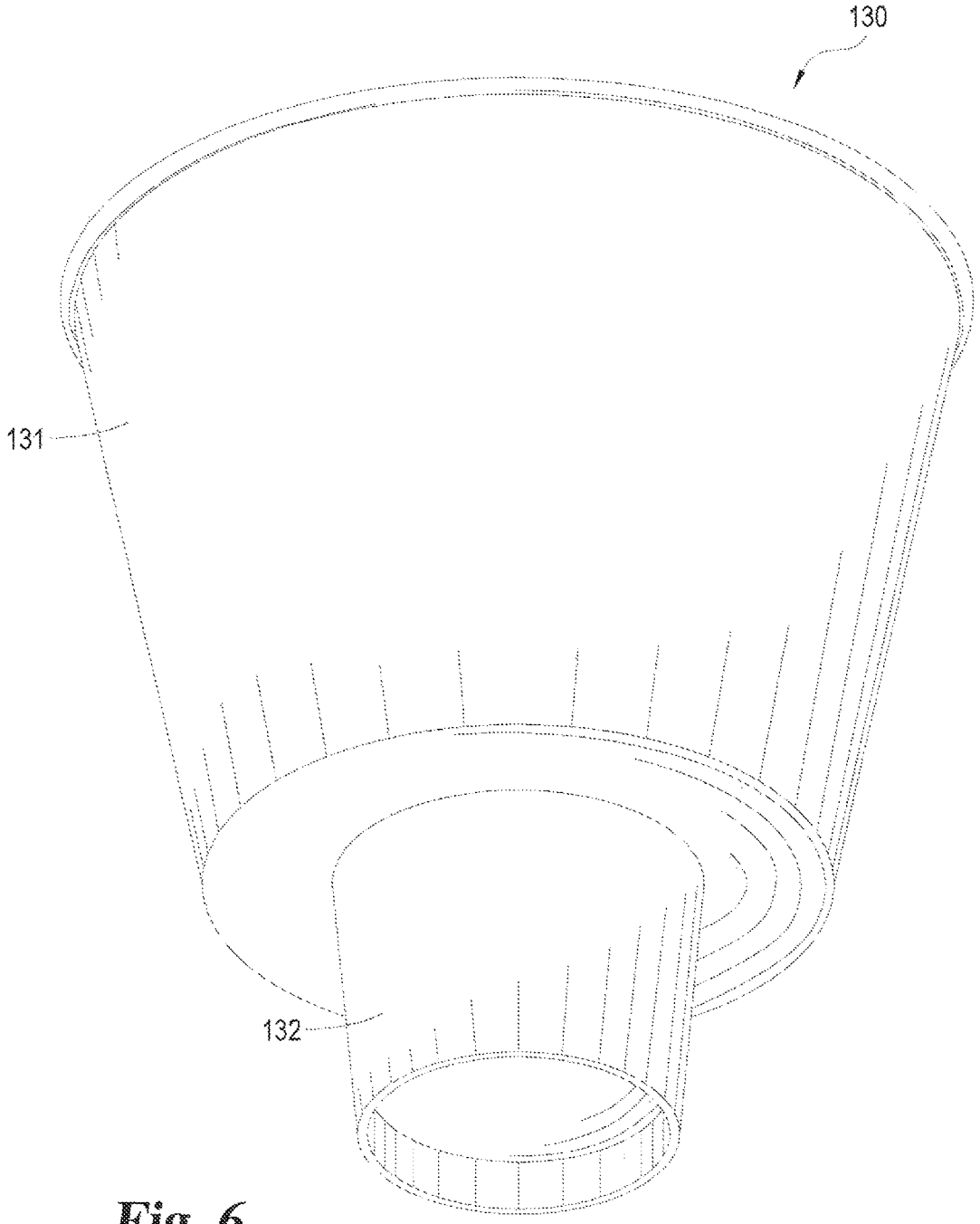
FIG. 6 is a bottom perspective view of an alternate embodiment of the bucket.
Figure 7:
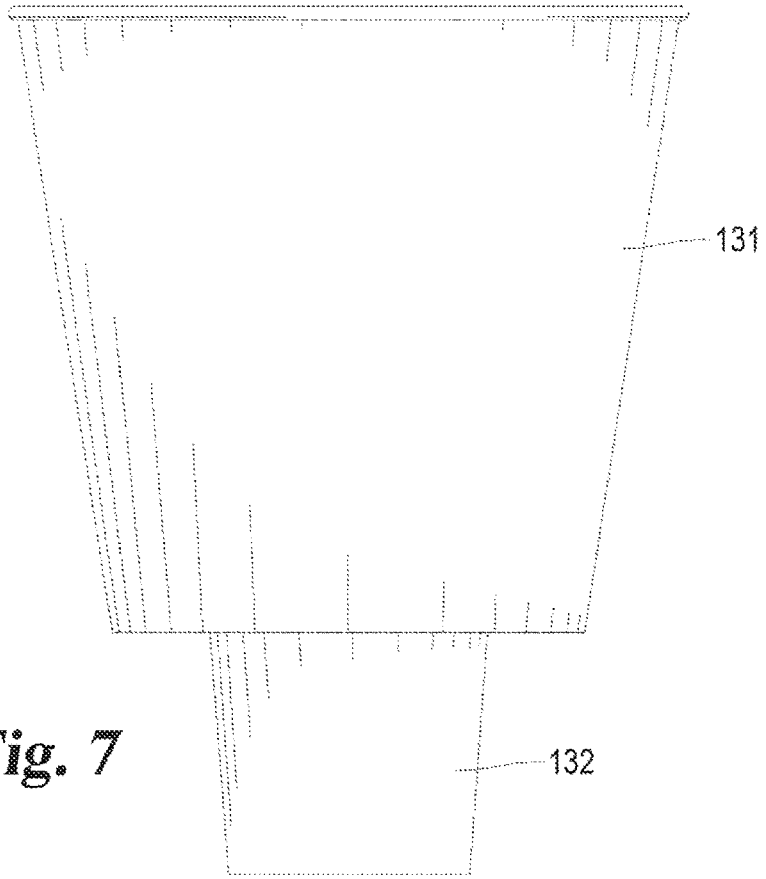
FIG. 7 is a front view of the bucket of FIG. 6 with the left side, right side, and rear side being identical thereto.
Figure 8:
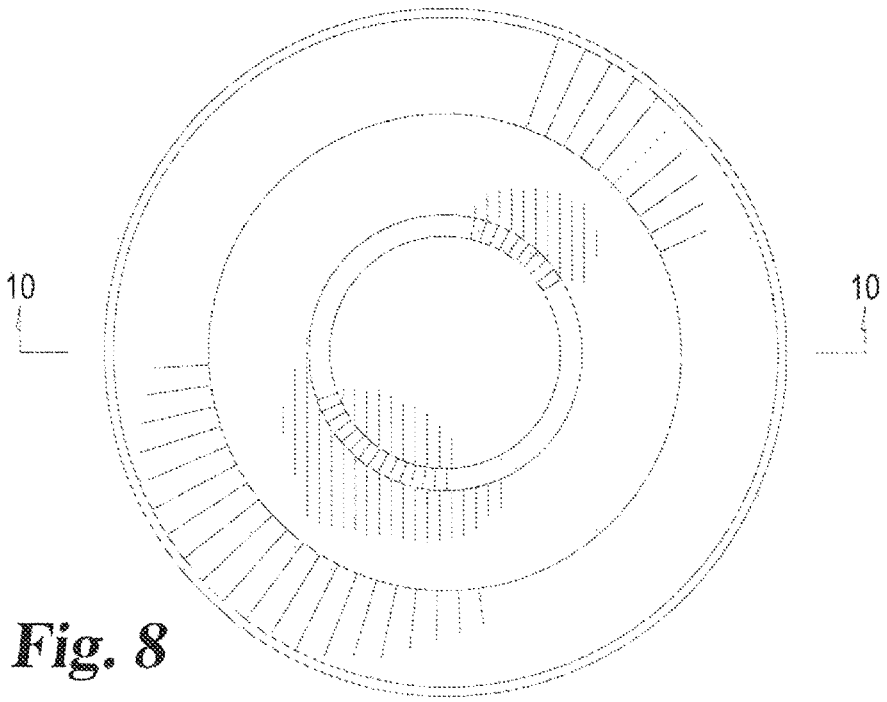
FIG. 8 is a top view of the bucket of FIG. 6.
Figure 9:
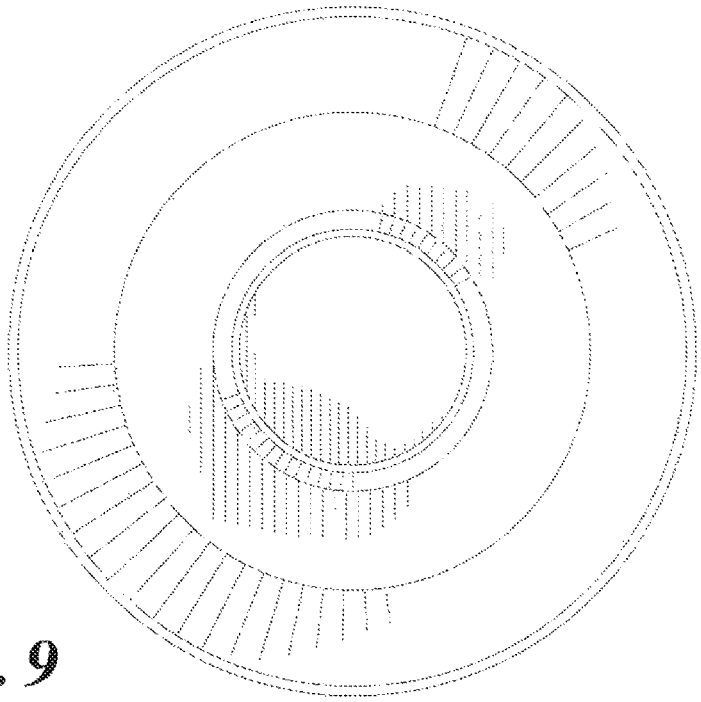
FIG. 9 is a bottom view of the bucket of FIG. 6.
Figure 10:
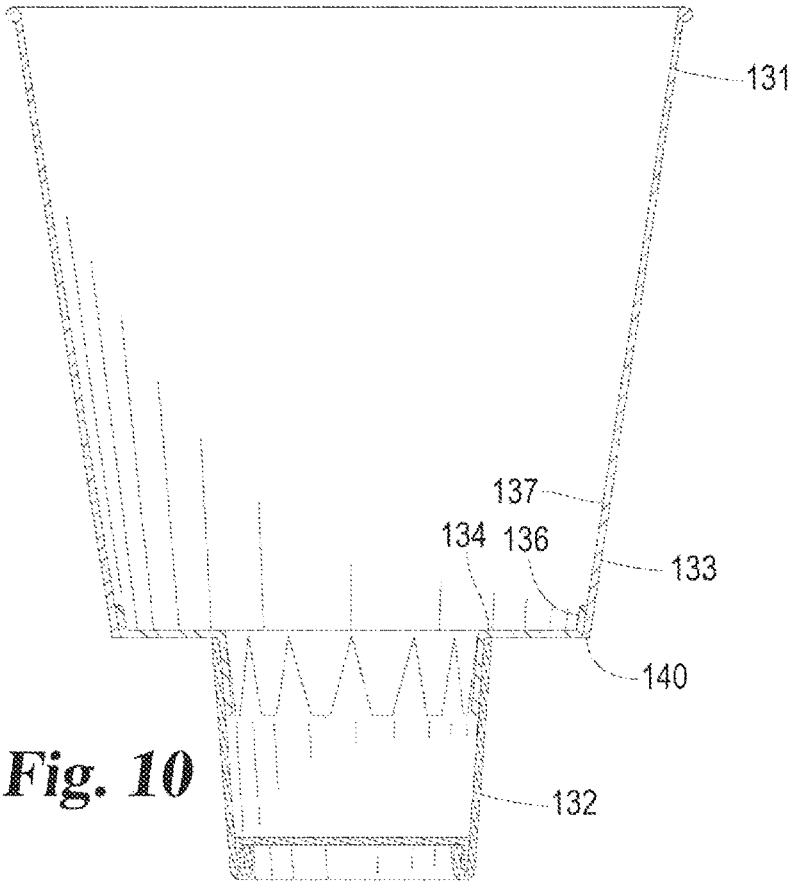
FIG. 10 is a cross sectional view thereof, taken from line 10-10 in FIG. 8.

Container side wall 33 (FIG. 1) extends downwardly beneath the container bottom wall 34 forming rim 41 surrounding the base side wall 55 forming the annular recess 70 located between the container side wall 33 and the downwardly extending portions 48 of the container bottom wall 34. Rim 41 provides rigidity for the container while supporting the container atop the arm of a chair particularly when the cup holder recess is larger than the outside diameter of the base. The cup holder recess 75 of the arm chair 76 is shown in phantom in FIG. 5 illustrating in one case that the recess 75 has a larger diameter than the maximum outside diameter of the base 32. Thus, container 31 rests on the upwardly facing surface of arm 76 with the bottom edge 42 of rim 41 preventing the container from rocking back and forth thereby preventing accidental spillage of the edible products within the container. In the event the maximum inside diameter of cup holder recess 75 is smaller than the largest outside diameter of base 32, then the base will wedge into the cup holder recess spacing the rim 41 apart from the arm with stability of the container then being provided due to the wedging action between the base and the chair.

The method of forming the bucket includes forming an upper container and a lower container and joining the containers together. The bucket can be produced manually one at a time or may be manufactured in large quantities in automated fashion. The bucket removably mounts into a cup holder formed in the arm of a chair. The upper container is formed by rolling a flat piece of wax coated paperboard having opposite end portions into an annular configuration. The top edge portion has a diameter larger that the bottom edge portion forming an inverted frustoconical shape. The opposite end portions are joined together forming the annular configuration providing an open top and an open bottom with the container side wall being continuous. The top edge portion of the side wall is curled forming a top rim whereas the bottom edge portion is folded inwardly and then upwardly forming a continuous container channel. The bottom wall of the upper container is a disk shaped piece and also is produced from wax coated paperboard having outer edge portions. The disk shaped bottom wall of the upper containers is extended across the open bottom of the upper container with the outer edge portions of the bottom wall being folded downwardly and inserted into the channel formed by the continuous side wall. The outer edge portions of the bottom wall are then joined inside the channel to the container side wall permanently affixing the two together. The outer edge portions of the bottom wall along with the bottom edge of the upper container form a container rim extending beneath the upper container bottom wall and surrounding the longitudinal axis The rim encircles a continuous annular recess surrounding the side wall of the lower container with the recess located between the upper container side wall and the downwardly extending portions of the upper container bottom wall thereby providing rigidity for the container wall supporting the container atop the rim of a chair. A central opening in the bottom wall is then formed by creating downwardly extending pieces of the bottom wall encircling the longitudinal axis of the bucket.

The method further includes producing the lower container which is a base holder in a similar manner as the upper container by rolling a flat piece of paperboard having opposite end portions joined together forming an inverted frustoconical shape. The downwardly extending portions of the upper container bottom wall are extended into the lower container adjacent the inside surface of the lower container side wall and are joined thereto. The bottom edge of the lower container side wall is folded inwardly and then upwardly forming a continuous base channel. The bottom wall of the base is formed from a disk shaped piece of wax coated paperboard having outer edge base portions that extend downwardly into the base channel and are joined to the side wall of the base in permanent fashion.

Many advantages of the present invention result from the disclosed structure. For example, the base rim 60 (FIG. 1) extends beneath the bottom wall of the base and provides rigidity for the lower cup shaped base when it is inserted into the cup holder recess of the arm chair. Likewise, rim 41 of the upper container not only provides for increased rigidity but also stability of the upper container in the event the cup holder recess is larger than the outside diameter of the base thereby allowing the rim to rest atop the arm chair and prevent the upper container from rocking back and forth thereby spilling the products contained therein. In the alternate embodiment of FIGS. 6-10, the bottom wall 134 is aligned with the bottom edge 140 of the side wall 133 forming together a planar surface allowing the planar surface to rest atop the upwardly facing surface of the arm in case the recess of the cup holder is larger than the maximum outside diameter of the lower side wall of the lower container 132 thereby preventing the container from rocking back and forth.

Many variations are contemplated and included in the present invention. For example, the base portion of the bucket will fit into cup holders of different types of chairs and various types of seating such as movie theatre seats/chairs, sport arena seats/chairs, and/or couches, sofas, recliners, love seats, etc. Likewise, although the bucket is described as being produced from wax coated paperboard, many other suitable paper/board materials are appropriate with many different types of adhesives and/or fasteners being utilized to join the components together. The side wall of the upper container and the side wall of the lower container are each of a one piece construction. Likewise, the upper container bottom wall and the lower container bottom wall are each of a one piece construction. Thus, the entire bucket is produced from four separate pieces that are joined together into a one piece unified structure. The method of construction is particularly low cost and efficient to use with the capacity of the container being maximized by allowing the edible products within the upper container to first fill the interior cavity of the base.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A hands free bucket for holding edible products including popcorn and being removably mountable into a recess of a cup holder formed in an arm of a chair comprising:

an upper container having a container side wall and a container bottom wall joined together with an open top forming a cavity for receiving edible products including popcorn, said container bottom wall having edge portions joined to said container side wall, said bottom wall further having a center portion with downwardly extending portions defining an opening allowing edible products in said container to fall downwardly from said container; and, a lower cup shaped base having a base side wall with inwardly facing surfaces and a base bottom wall joined to said base side wall, said base side wall sized to fit into a recess of a cup holder formed in an arm of a chair supporting said upper container there above, said downwardly extending portions of said container bottom wall extend into said base resting against said inwardly facing surfaces of said base side wall and joined thereto securing said upper container to said lower cup shaped base and allowing edible products in said container to fall downwardly therefrom into said base; and wherein:

said container side wall extending downwardly from said container bottom wall forming a rim extending beneath said container bottom wall surrounding said base side wall forming an annular recess located between said container side wall and said downwardly extending portions of said container bottom wall, said rim providing rigidity for said container while resting atop and supporting said container atop the arm of the chair.

2. The bucket of claim 1 wherein said container side wall has an inverted frustoconical shape having a cylindrical top edge with said cylindrical top edge of diameter greater than that of said rim.

3. The bucket of claim 2 wherein:

said base side wall extending downwardly from said base bottom wall providing rigidity for said lower cup shaped base.

4. The bucket of claim 3 wherein:

said base side wall has a diameter smaller than said container side wall.

5. The bucket of claim 4 wherein:

said rim of said container side wall turns inwardly and then upwardly forming a continuous container channel, said edge portions of said container bottom wall extend to said container side wall and then downwardly adjacent said container side wall into said container channel being secured therein; and, said base side wall has a cylindrical bottom edge which turns inwardly and then upwardly forming a continuous base channel, said base bottom wall extends to said base side wall and then downwardly adjacent said base side wall into said base channel.

6. A container for holding items and being mountable to a cup holder of a chair arm comprising:

an upper container having a continuous ring shaped top side wall forming an open top and a bottom, said upper container having an upper container bottom wall extending across said bottom and joined to and along said continuous ring shaped side wall, said upper container bottom wall having a central opening with a downwardly extending portion allowing items within said upper container to fall therethrough; and, a lower container having a continuous ring shaped lower side wall to removably fit into a cup holder of a chair arm, said lower side wall having inwardly facing surfaces secured to said downwardly extending portion of said upper container bottom wall and being aligned with said central opening to receive items falling through said central opening from said upper container, said upper container bottom wall aligned with said upper container side wall forming a planar surface to rest atop a chair arm when said lower container extends into a cup holder of the chair arm limiting relative motion therebetween.

7. The container of claim 6 wherein:

said upper container and said lower container are produced from four separate pieces of wax coated paperboard joined together into a unified structure.

8. The container of claim 7 wherein:

said top side wall is of a one piece construction with opposite ends fixedly joined together, said upper container bottom wall with a downwardly extending portion is of a one piece construction, said lower side wall is also of a one piece construction with opposite ends fixedly joined together with said lower container having a lower container bottom wall of a one piece construction.

9. The container of claim 8 wherein:

said lower side wall extends below said lower container bottom wall forming an annular recess surrounding said lower side wall.

* * * * *